US008581482B2

(12) United States Patent
Veiga et al.

(10) Patent No.: US 8,581,482 B2
(45) Date of Patent: Nov. 12, 2013

(54) PAR LAMP AND METHOD OF MAKING SAME

(75) Inventors: Louie Veiga, Nashua, NH (US); Renaud Richard, Manchester, NH (US); Harold Rothwell, Jr., Hopkinton, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 708 days.

(21) Appl. No.: 12/387,240

(22) Filed: Apr. 30, 2009

(65) Prior Publication Data

US 2010/0279574 A1 Nov. 4, 2010

(51) Int. Cl.
*H01J 19/54* (2006.01)

(52) U.S. Cl.
USPC ..... 313/313; 445/23; 313/113; 313/318.11; 313/634

(58) Field of Classification Search
USPC ..... 313/113, 318.11, 634; 445/23
See application file for complete search history.

(56) References Cited

U.S. PATENT DOCUMENTS

| | | | | |
|---|---|---|---|---|
| 3,806,236 | A * | 4/1974 | Downing | 353/97 |
| 4,138,621 | A * | 2/1979 | Downing et al. | 313/113 |
| 5,993,034 | A | 11/1999 | Kace, Jr. et al. | |
| 6,215,254 | B1 * | 4/2001 | Honda et al. | 315/246 |
| 6,916,204 | B2 | 7/2005 | Duarte et al. | |
| 2006/0126333 | A1 * | 6/2006 | Goto et al. | 362/262 |
| 2006/0216333 | A1 * | 9/2006 | Miller et al. | 424/443 |

* cited by examiner

*Primary Examiner* — Nimeshkumar Patel
*Assistant Examiner* — Jacob R Stern
(74) *Attorney, Agent, or Firm* — Edward S. Podszus

(57) ABSTRACT

A method of making a subassembly (10) for a PAR lamp (12) comprising the steps of: (a) providing a base (14) including a cup-shaped portion (16) with a top edge (18) having an extended flange (20) projecting therefrom; (b) providing a plurality of electrical contacts (22, 24) and inserting the contacts into appropriate locations (22*a*, 24*a*) in a bottom (26) of the cup-shaped portion (16); (c) providing a lamp capsule (28) including a light source (30) having dependent leads (32, 34) projecting from a base end (36); (d) inserting the base end (36) of the lamp capsule (28) into the cup-shaped portion (16) and affixing the dependent leads (32, 34) to the electrical contacts (22, 24); (e) providing a reflector (38) having a funnel-shaped body (40) with a substantially tubular neck (42); (f) filling the cup-shaped portion (16) with a liquid cement (44) to a depth that covers the base end (36) of the lamp capsule (28); (g) fitting the reflector (38) over the lamp capsule (28) so that the tubular neck (42) is submersed in the liquid cement (44); and (h) heating the subassembly (10) to fix the reflector (38) in place.

11 Claims, 6 Drawing Sheets

PAR LAMP AND METHOD OF MAKING SAME

TECHNICAL FIELD

This invention relates to PAR lamps and more particularly to a method of making such PAR lamps. Still more particularly, it relates to PAR lamps with an arc discharge light source and to such lamps containing an integral ballast for the light source.

BACKGROUND ART

PAR lamps are typically comprised of a light source such as a tungsten halogen capsule or a high intensity discharge (HID) arc tube mounted within a glass body in conjunction with a parabolic reflector. The glass body can be pressed borosilicate glass. A lens usually covers the front or light-emitting end of the body and can contain optical elements to provide a desired beam shape (for example, a spot or flood beam). General service PAR lamps usually have a neck region between the parabolic reflector and the base, and the base generally comprises a threaded fitting for connecting the lamp to a power source via a socket. The usual power source is 100 to 240 volts. The neck provides the mechanical support between the reflector optical portion and the base electrical portion. The neck additionally provides room for the capsule press seal, the lead-ins, capsule mounting components, and wiring and separates the light source (i.e., the filament or arc discharge) from the base to reduce the base temperature. Additionally, when the light source is an arc discharge source, the neck area can also contain the appropriate integral ballast for the arc discharge light source. It is with the latter type of PAR lamp that this invention pertains.

Integrally ballasted HID PAR lamps generate considerable heat which must be appropriately handled for the lamp to operate properly and, in addition to the visible light they provide, often emit undesired electromagnetic interference (EMI). Such EMI can have unwanted side effects and its reduction is a very desired feature.

In the prior art, such reduction has been accomplished by applying shielding between a light and a complementary module (U.S. Pat. No. 6,916,204 B2) or by connecting the reflective coating on a reflector to system ground whereby extraneous radio frequency emissions are shielded by the reflector (U.S. Pat. No. 5,993,034).

Such techniques have been difficult to accomplish in integrally ballasted PAR lamps, which also require critical alignment of the components and special techniques for fabricating the reflectors.

DISCLOSURE OF INVENTION

It is, therefore, an object of the invention to obviate the disadvantages of the prior art.

It is another object of the invention to enhance the operation of integrally ballasted PAR lamps.

It is yet another object of the invention to improve the performance of integrally ballasted PAR lamps.

These objects are accomplished, in one aspect of the invention, by a method of making a subassembly for a PAR lamp comprising the steps of: providing a base including a cup-shaped portion with a top edge having an extended flange projecting therefrom; providing a plurality of electrical contacts and inserting the contacts into appropriate locations in a bottom of the cup-shaped portion; providing a lamp capsule including a light source having dependent leads projecting from a base end; inserting the base end of the lamp capsule into the cup-shaped portion and affixing the dependent leads to the electrical contacts; providing a reflector having a funnel-shaped body with a substantially tubular neck; filling the cup-shaped portion with a liquid cement to a depth that covers the base end of the lamp capsule; fitting the reflector over the lamp capsule so that the tubular neck is submersed in the liquid cement; and heating the subassembly to fix the reflector in place.

A method is provided also for making the improved PAR lamp, which comprises the steps of: making a subassembly; providing a funnel-shaped housing including a tubular termination; providing a heat sink to fit substantially in the tubular termination: providing an electronic ballast for the light source contained within the subassembly; fitting the electronic ballast within the heat sink; providing an electrical EMI-reducing contact having a proximal end contacted by the heat sink, a body portion aligned along an interior surface of the funnel-shaped housing and having a distal end provided with at least one sharp edge; fitting the subassembly within the funnel-shaped housing in a manner whereby the sharp edge of the distal end makes electrical contact with the outer surface of the reflector; and completing the lamp.

The techniques described above rigidly fix the components in desired locations and substantially reduce the undesired EMI.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 3:
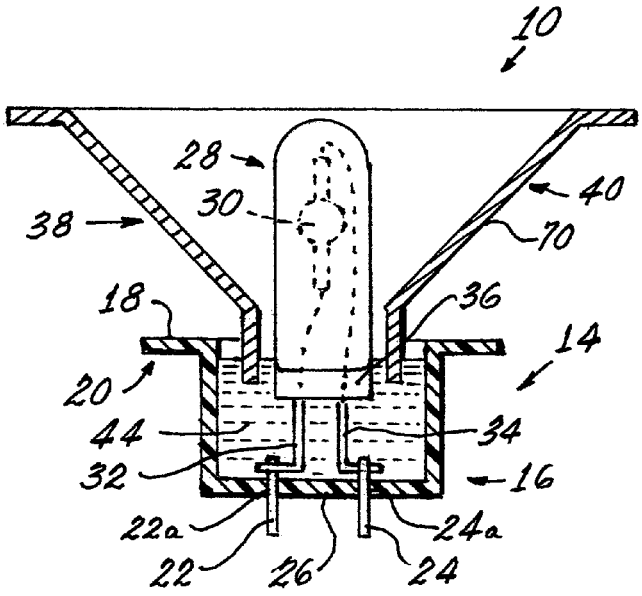
FIG. 3 is a diagrammatic sectional view of a completed subassembly in accordance with an aspect of the invention.
Figure 5:
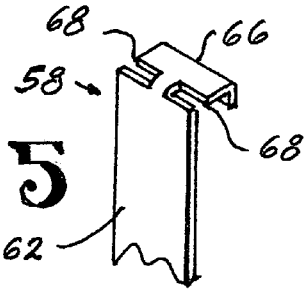
FIG. 5 is a partial, perspective view of an EMI-reducing contact in accordance with an aspect of the invention.

Referring now to the drawings with greater particularity, there is shown in FIG. 3 a subassembly 10 for a PAR lamp 12 comprising a base 14 including a cup-shaped portion 16 with a top edge 18 having an extended flange 20 projecting therefrom. The base 14 is preferably formed from a liquid crystal polymer.

A plurality of electrical contacts 22, 24 are fitted into appropriate locations 22*a*, 24*a* in a bottom 26 of said cup-shaped portion 16 and a lamp capsule 28, including a light source 30, having dependent leads 32, 34 projecting from a base end 36 is fitted into the cup-shaped portion 16 with the dependent leads 32, 34 electrically and mechanically connected to the electrical contacts 22, 24. The lamp capsule 28 preferably is formed of quartz and the light source 30 preferably is a substantially bulbous ceramic arc tube.

A cement 44 fills the cup-shaped portion to a depth that covers the base end 36 of said lamp capsule 28 and a reflector 38 with a funnel-shaped body 40 and a substantially tubular neck 42 is positioned over the lamp capsule with the tubular neck penetrating the cement, whereby the reflector 38 is fixed in position. If desired, the interior of the cup-shaped portion 16 can be provided with ribs to aid in centering the reflector 38.

The cement 44 is a material having a low expansion and a high thermal conductivity, for example, Sauereisen No. 29, a commercially available cement.

The reflector 38 is formed by a spinning process followed by an anodizing process to render a surface of high reflectivity, a desired condition, but of low electrical conductivity, an undesired condition that introduces unwanted effects, which will be dealt with hereinafter.

Figure 1:
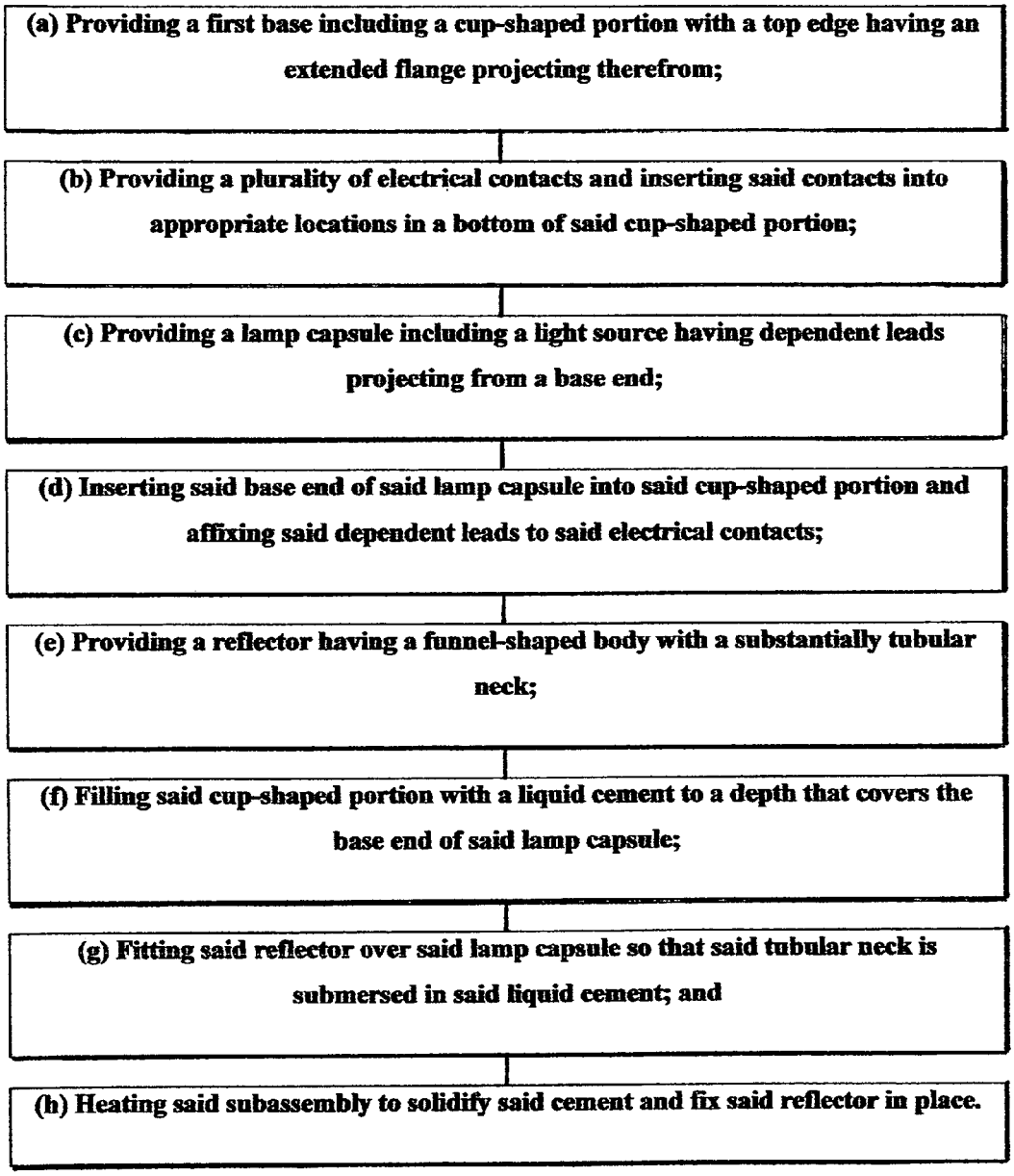
FIG. 1 is a flow diagram of a method of making a subassembly, according to an aspect of the invention.

Referring now to FIG. 1, there is shown a flow diagram of the method of making the subassembly 10. The method comprises the steps of: providing a base 14 with a cup-shaped portion 16 having a top edge 18 with an extended flange 20 projecting therefrom; providing a plurality of electrical contacts 22, 24 and inserting the contacts into appropriate locations 22*a*, 24*a* in a bottom 26 of the cup-shaped portion 16; providing the lamp capsule 28 including the light source 30 having dependent leads 32, 34 projecting from a base end 36; inserting the base end 36 of the lamp capsule 28 into the cup-shaped portion 16 and affixing the dependent leads 32, 34 to the electrical contacts 22, 24; providing a reflector 38 having a funnel-shaped body 40 with a substantially tubular neck 42; filling the cup-shaped portion 16 with the liquid cement 44 to a depth that covers the base end 36 of the lamp capsule 28; fitting the reflector 38 over the lamp capsule 28 so that the tubular neck 42 is submersed in the liquid cement 44; and heating the subassembly 10 to fix the reflector 38 in place.

Figure 2A:
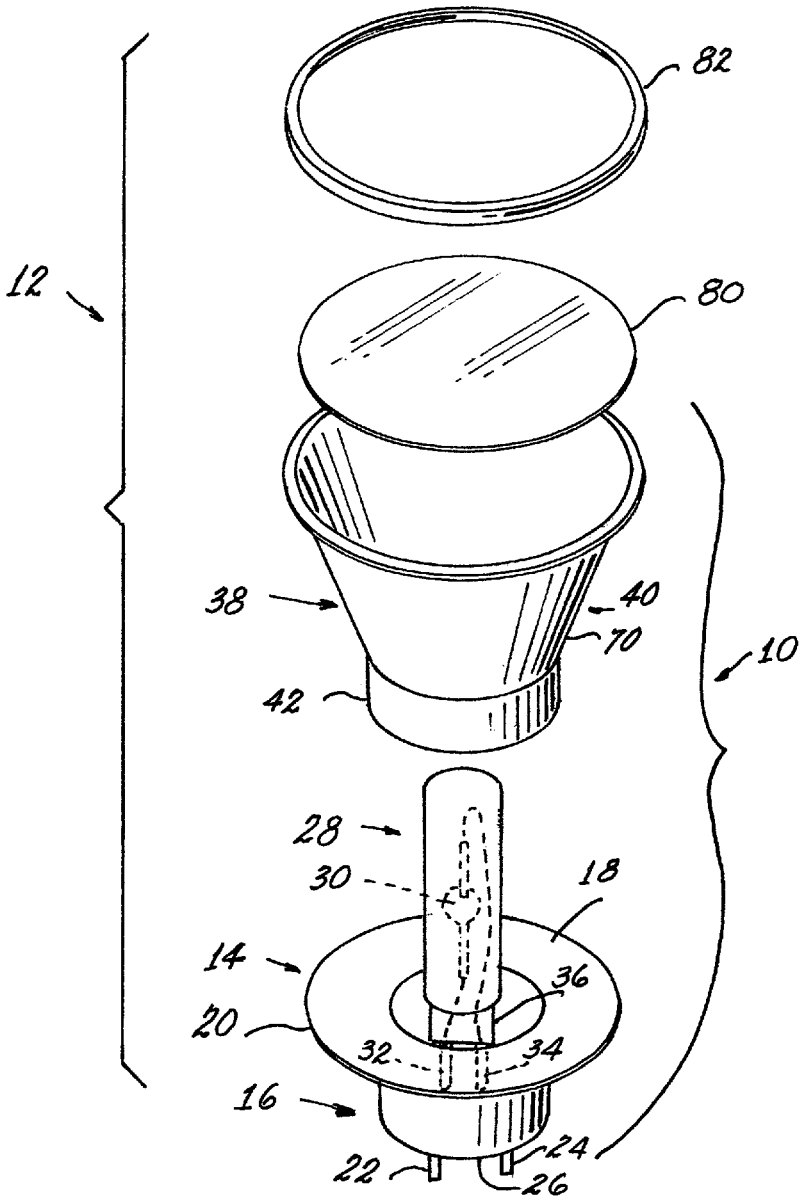
FIGS. 2A and 2B are a diagrammatic, exploded view of a lamp made in accordance with an aspect of the invention.
Figure 2B:
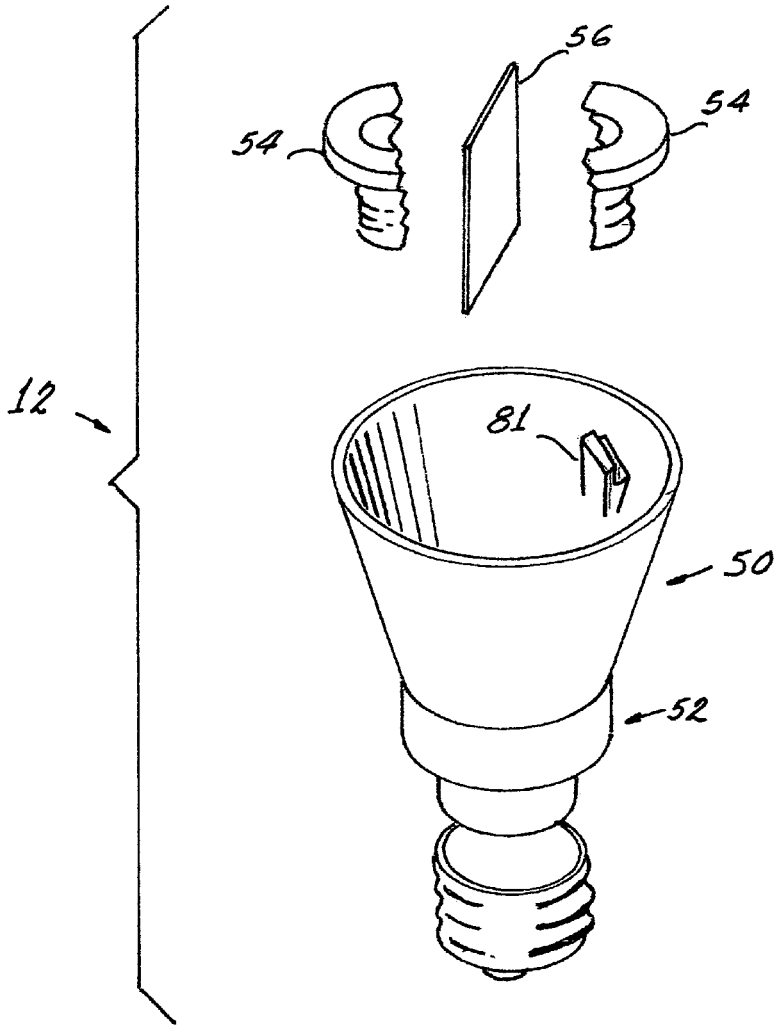
Figure 4:
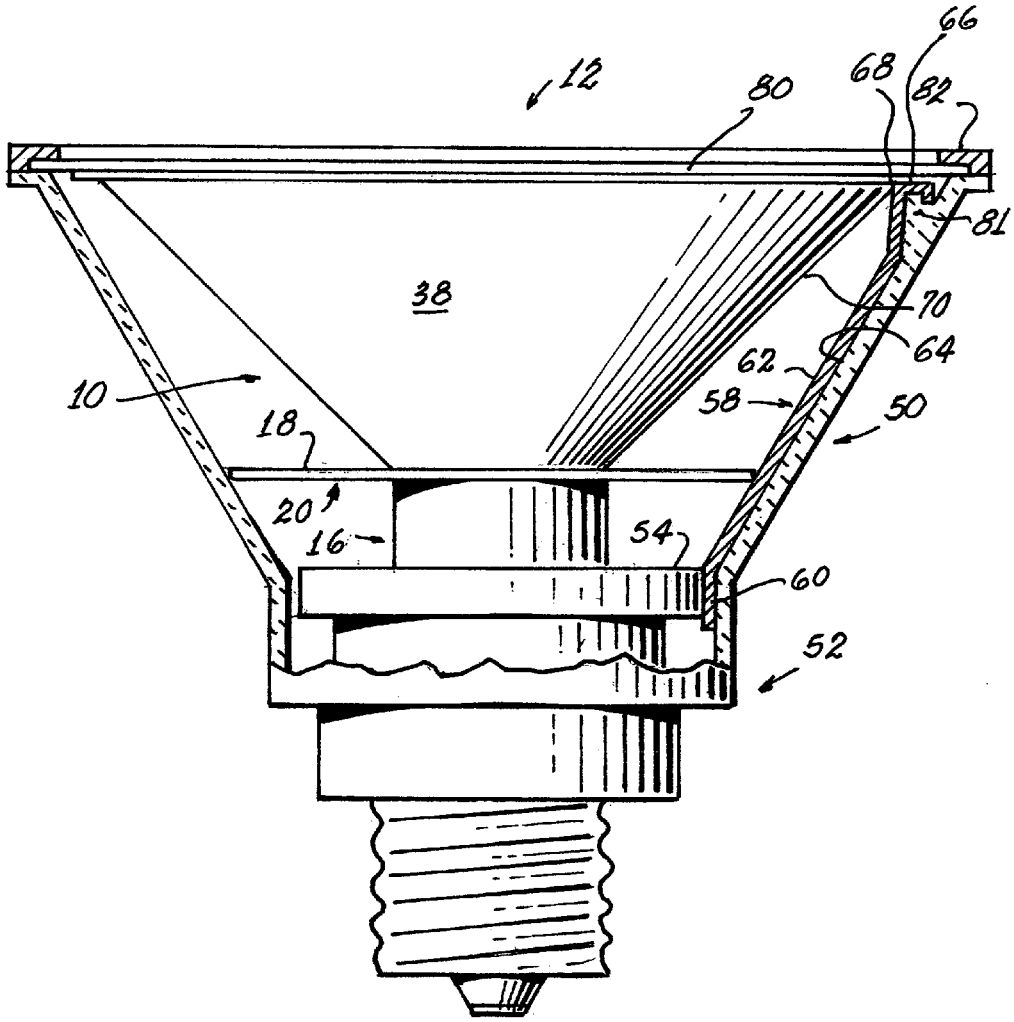
FIG. 4 is a similar view of a completed lamp, in accordance with an aspect of the invention.
Figure 6:
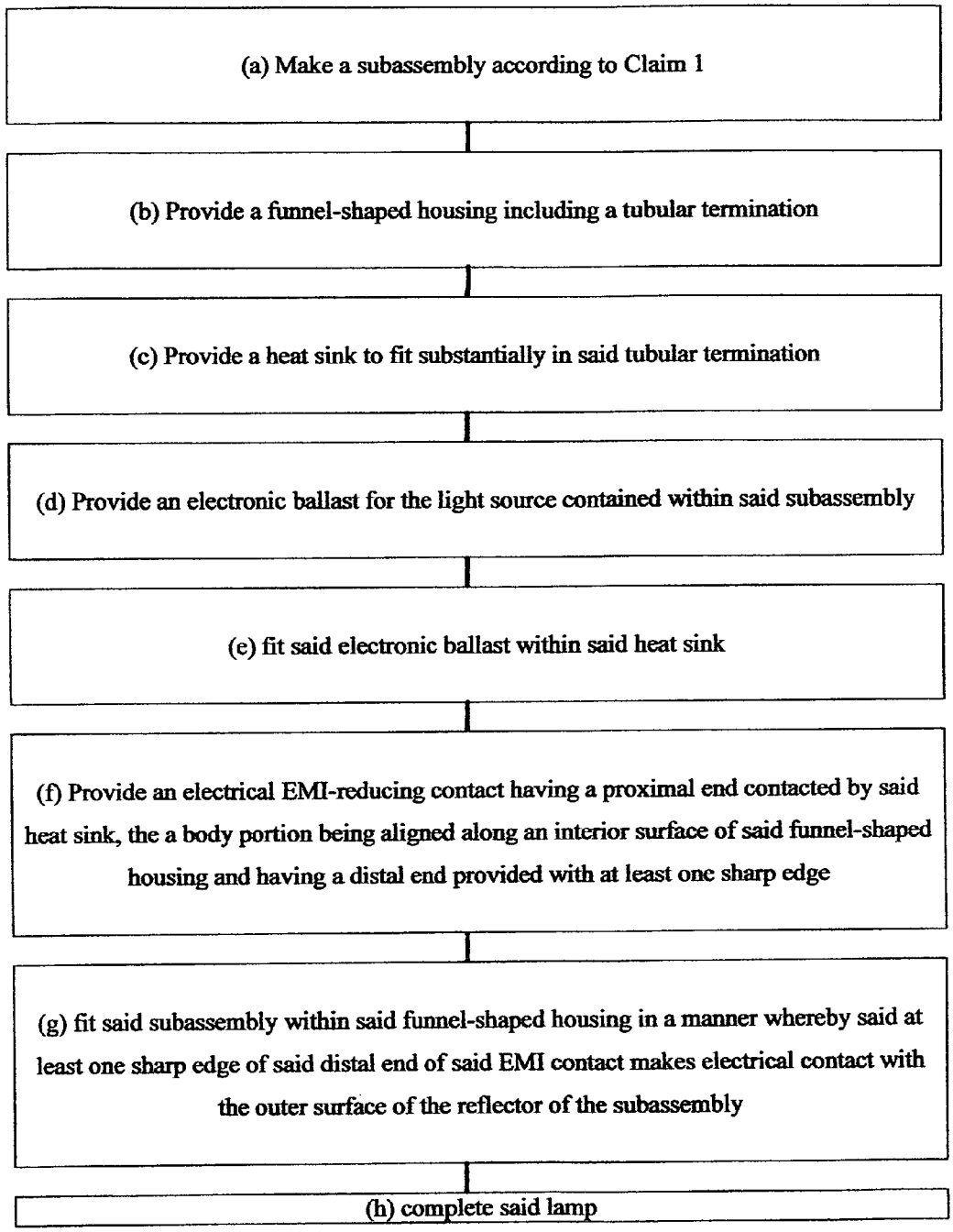
FIG. 6 is a flow diagram of a method of making a lamp in accordance with an aspect of the invention.

Referring now to FIGS. 2A, 2B and 4, it will be seen that the subassembly 10 comprises a major part of the PAR lamp 12. In addition to the subassembly 10, the PAR lamp 12 includes a funnel-shaped housing 50 including a tubular termination 52. The housing 50 is constructed of an electrically insulating material, such as, for example, a plastic.

A heat sink 54 fits substantially in the tubular termination 52 and surrounds an electronic ballast 56 for the light source 30 that is contained within the subassembly 10.

As noted above, integrally ballasted HID light sources not only produce desired radiation within the visible spectrum but they may also produce undesired radio frequency radiation that provides the unwanted EMI. Such EMI radiation can be reduced in such lamps by connecting the reflector to the system ground, whereby the EMI is effectively shielded by the reflector; however, due to the manner of making the instant reflector such a condition is not directly possible because the anodized coating on the reflector 38 is not a good electrical conductor.

To ameliorate this problem an electrical EMI-reducing contact 58 is positioned in the funnel-shaped housing 50. The contact 58 has a proximal end 60 contacted by the heat sink 54, a body portion 62 aligned along an interior surface 64 of the funnel-shaped housing 50 and having a distal end 66 provided with at least one sharp edge 68. Preferably, the EMI-reducing contact 58 has two sharp edges 68. The EMI-reducing contact 58 is connected to the return lead of the light source, for example, lead 34, through the ballast heat sink 54 and, thus, to the reflector via the edges 68 which scrape through the anodized coating on the reflector.

To maintain the EMI contact in position during assembly and during operation the funnel-shaped housing 50 includes a pocket 81 for the receipt of the distal end 66.

The subassembly 10 is fitted within the funnel-shaped housing 50 in a manner whereby the sharp edges 68 of the distal end 66 scrape through the anodized coating and make electrical contact with the outer surface 70 of the reflector 38 of the subassembly 10.

Thereafter, the lamp 12 is completed by adding the lens 80 and the sealing rim 82.

The subassembly and the lamp thus produced by this method provide a lamp with well-aligned components and reduced EMI.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A method of making a PAR lamp comprising the steps of:

(i) making a subassembly for the PAR lamp comprising the steps of (a) providing a base including a cup-shaped portion with a top edge having an extended flange projecting therefrom;

(b) providing a plurality of electrical contacts and inserting the contacts into appropriate locations in a bottom of the cup-shaped portion;

(c) providing a lamp capsule including a light source having dependent leads projecting from a base end;

(d) inserting the base end of the lamp capsule into the cup-shaped portion and electrically and mechanically connecting the dependent leads to the electrical contacts;

(e) providing a reflector having a funnel-shaped body with a substantially tubular neck;

(f) filling the cup-shaped portion with a liquid cement to a depth that covers the base end of the lamp capsule;

(g) fitting the reflector over the lamp capsule so that the tubular neck is submersed in the liquid cement; and (h) heating the subassembly such that the cement fixes the reflector in place;

(ii) providing a funnel-shaped housing (50) including a tubular termination;

(iii) providing a heat sink (54) to fit substantially in the tubular termination;

(iv) providing an electronic ballast for the light source contained within the subassembly;

(v) fitting the electronic ballast within the heat sink;

(vi) providing an electrical EMI-reducing contact (58) having a proximal end contacted by the heat sink (54), a body portion aligned along an interior surface of the funnel-shaped housing and having a distal end provided with at least one sharp edge; and (vii) fitting the subassembly within the funnel-shaped housing in a manner whereby the sharp edge of the distal end makes electrical contact with the outer surface of the reflector and the proximal end makes electrical contact with one said dependent lead (34) through the heat sink (54).

2. The method of claim 1 wherein the heating is at a temperature of up to 200° C.

3. The method of claim 1 wherein the base is constructed of an electrically insulating material.

4. The method of claim 3 wherein the electrically insulating material is a liquid crystal polymer.

5. The method of claim 1, wherein the EMI-reducing contact has two sharp edges.

6. The method of claim 1, wherein the funnel-shaped housing includes a pocket for the receipt of the distal end.

7. The method of claim 6 wherein the EMI-reducing contact is electrically connected to the return lead of the light source via the heat sink.

8. A PAR lamp comprising:

(i) a PAR lamp subassembly (10) comprising:

(a) a base including a cup-shaped portion with a top edge;

(b) a plurality of electrical contacts fitted into appropriate locations in a bottom of said cup-shaped portion;

(c) a lamp capsule including a light source having dependent leads projecting from a base end, said base end of said lamp capsule being fitted into said cup-shaped portion with said dependent leads electrically and mechanically connected to said electrical contacts;

(d) a cement filling said cup-shaped portion to a depth that covers the base end of said lamp capsule; and (e) a reflector having a funnel-shaped body with a substantially tubular neck positioned over said lamp capsule with said tubular neck penetrating said cement, whereby the cement fixes said reflector in position; and (ii) a funnel-shaped housing (50), the subassembly (10) being fitted within the funnel-shaped housing; and (iii) an electrical EMI-reducing contact (58) having a proximal end, a body portion aligned along an interior surface of the funnel-shaped housing and having a distal end, the proximal end being in electrical contact with one said dependent lead (34), and the distal end being in electrical contact with an outer surface of the reflector.

9. The subassembly of claim 8, wherein the top edge has an extended flange projecting from the top edge.

10. The subassembly of claim 8, wherein the cement fills the cup-shaped portion to a depth that covers the base end of the lamp capsule and the dependent leads and the plurality of electrical contacts.

11. The PAR lamp of claim 8, wherein one of the dependent leads is a return lead of the light source and the electrical EMI-reducing contact is electrically connected to the return lead.

* * * * *